US007909309B2

(12) United States Patent
Major et al.

(10) Patent No.: US 7,909,309 B2
(45) Date of Patent: Mar. 22, 2011

(54) ANTIPERSONNEL BARRIER SYSTEM

(75) Inventors: Robert W. Major, Nelson, MO (US); Donald Scott Shipley, Newark, OH (US)

(73) Assignee: Allied Tube & Conduit Corporation, Harvey, IL (US)

( * ) Notice: Subject to any disclaimer, the term of this patent is extended or adjusted under 35 U.S.C. 154(b) by 0 days.

(21) Appl. No.: 11/313,485

(22) Filed: Dec. 20, 2005

(65) Prior Publication Data

US 2006/0214148 A1 Sep. 28, 2006

Related U.S. Application Data

(60) Provisional application No. 60/665,782, filed on Mar. 28, 2005.

(51) Int. Cl.
*B21F 25/00* (2006.01)
*E04H 17/02* (2006.01)

(52) U.S. Cl. ..... 256/2

(58) Field of Classification Search ..... 256/2–9; 248/545

See application file for complete search history.

(56) References Cited

U.S. PATENT DOCUMENTS

| | | | | | |
|---|---|---|---|---|---|
| 561,849 | A * | 6/1896 | Woodward | 256/31 |
| 741,095 | A * | 10/1903 | Bayless et al. | 256/63 |
| 2,826,281 | A * | 3/1958 | Johnson | 52/158 |
| 3,155,374 | A * | 11/1964 | Sieffert | 256/2 |
| 4,484,729 | A * | 11/1984 | Mainiero et al. | 256/1 |
| 4,712,762 | A * | 12/1987 | Liedle | 248/533 |
| 4,744,708 | A * | 5/1988 | Cochrane | 410/47 |
| 4,929,926 | A * | 5/1990 | Porat | 340/541 |
| 5,104,074 | A * | 4/1992 | Malloy | 248/156 |
| 5,240,230 | A * | 8/1993 | Dougherty | 256/31 |
| D426,489 | S * | 6/2000 | Winderl | D11/120 |
| 6,682,279 | B2 * | 1/2004 | Pessach et al. | 410/36 |
| 2003/0099523 | A1 * | 5/2003 | Pessach et al. | 410/42 |
| 2006/0022184 | A1 * | 2/2006 | Pavlov | 256/2 |
| 2006/0022185 | A1 * | 2/2006 | Pavlov | 256/5 |

* cited by examiner

*Primary Examiner* — Joshua T Kennedy
(74) *Attorney, Agent, or Firm* — Kacvinsky Daisak PLLC

(57) ABSTRACT

An antipersonnel barrier system includes at least one concertina coil and a plurality of spaced support members. Each of the support members includes a base section and a vertical section. Each of the concertina coils is secured to the support members to provide a horizontally and vertically stabilized barrier. A length limiting cable is provided to limit the length of spacing between adjacent support members. The support members can include anchoring structure for securing the support members to a support surface. In one embodiment, the concertina coils include two small diameter base coils and a top coil positioned on the base coils.

19 Claims, 8 Drawing Sheets

ANTIPERSONNEL BARRIER SYSTEM

This application claims priority from U.S. provisional application Ser. No. 60/665,782 filed Mar. 28, 2005, the entire contents of which is incorporated herein by reference in its entirety.

BACKGROUND

1. Technical Field

The present disclosure relates to a transportable barrier which can be rapidly deployed. More specifically, the present disclosure relates to a transportable barrier which includes support structure to facilitate rapid stable deployment.

2. Background of Relate Art

Transportable barriers for defining a confined or protected area which can be rapidly deployed are well known. Typically, such barriers include one or more concertina coils which are stored in a compressed fashion and axially extended to deploy. The concertina coils may be constructed from a variety of diameters and include a variety of barbed configurations.

One problem associated with known rapidly deployable barriers is that during and/or after deployment, the barrier becomes misaligned and does not attain or retain a desired deployed configuration. For example, during and/or after deployment, the barrier may be overextended or underextended and/or the concertina coils may sag or become misaligned. As a result of such misalignment, the effectiveness of the barrier is reduced.

Accordingly, a rapidly deployable barrier which has improved stability and retains a desired orientation during and after deployment is desired.

SUMMARY

In accordance with the present disclosure, an antipersonnel barrier system is provided which includes at least one concertina coil and a plurality of support members. Each of the support members is secured to the at least one concertina coil to provide horizontal and vertical stability to the coils.

In one embodiment, the antipersonnel barrier system includes three coils including two base coils and one top coil. It is envisioned that greater or fewer coils may be provided. The support members each include a base section and a vertical section. The vertical section extends to at least substantially the height of the top coil and is attached thereto to provide vertical stability to the barrier system. The base section of the support member can be attached to the base coils at two locations to provide horizontal stability to the barrier system.

In one embodiment, each of the support members is attached to adjacent support members by a cable which prevents separation of adjacent support members beyond a predetermined distance, e.g., 9 feet. The cable prevents over extension of the barrier system.

Each of the base coils can be secured to the top coil to provide added stability to the barrier system. Anchoring structure including stakes, hooks or the like can be provided to secure or anchor the support members and/or coils to a support surface, e.g., ground.

A deployment carriage can be provided for supporting and transporting a non-deployed barrier system and for assisting in deployment of the barrier system.

BRIEF DESCRIPTION OF THE DRAWINGS

Various embodiments of the presently disclosed antipersonnel barrier are disclosed herein with reference to the drawings, wherein.

DETAILED DESCRIPTION OF EMBODIMENTS

Figure 1:
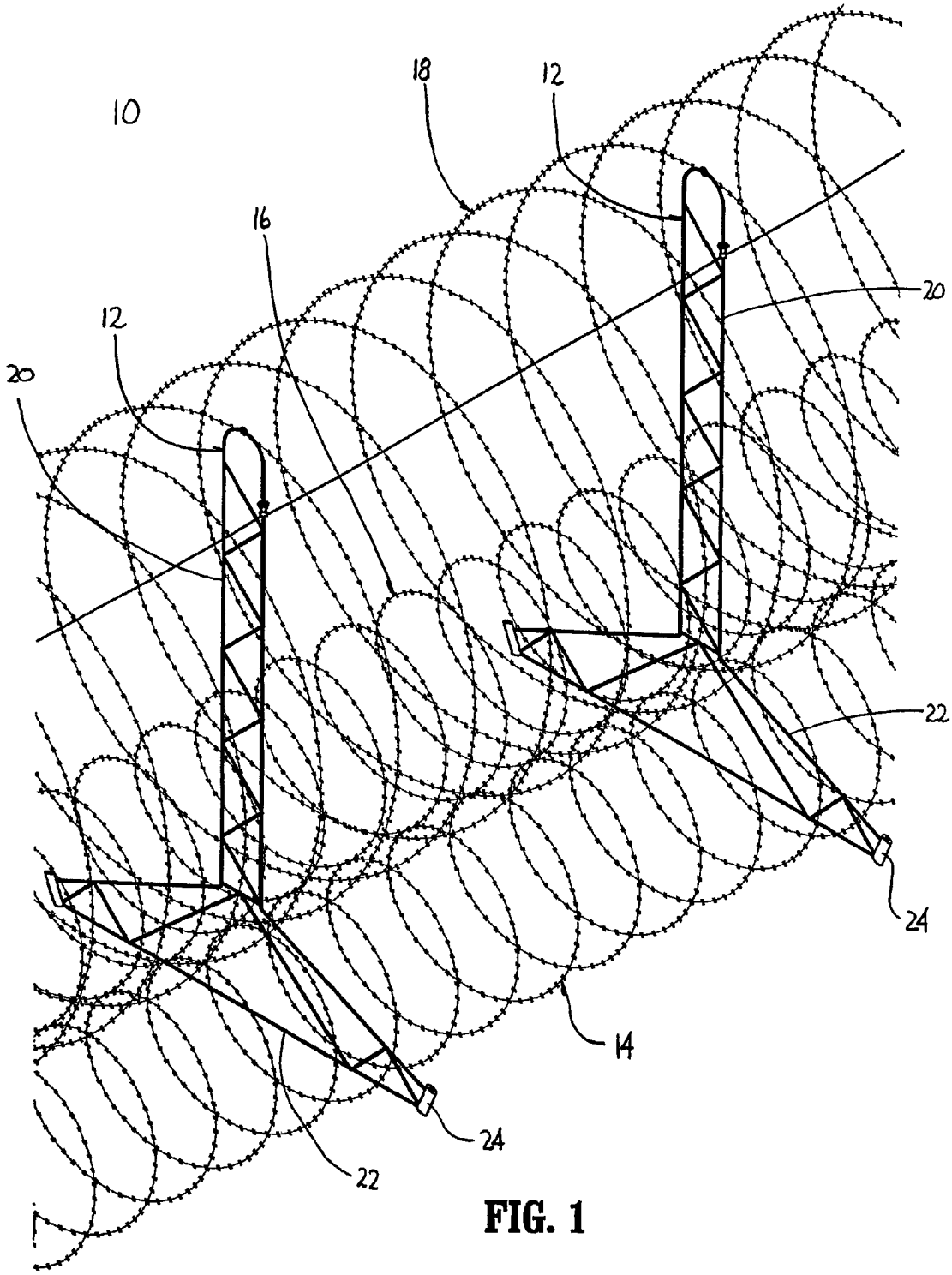
FIG. 1 is a side perspective view of a central portion of one embodiment of the presently disclosed antipersonnel barrier system illustrating a pair of spaced support members and the concertina coils.

Embodiments of the presently disclosed antipersonnel barrier system and its method of deployment will now be described in detail with reference to the drawings in which like reference numerals designate identical or corresponding elements in each of the several views.

As used herein, the term concertina coils means any wire or coil for resisting passage including barbed wire, razor wire, electrified wire, barbed tape and any other coil with or without structure for inflicting bodily harm.

FIG. 1 illustrates one embodiment of the presently disclosed antipersonnel barrier system shown generally as 10. Antipersonnel barrier system 10 includes at least one concertina coil and a plurality spaced support members 12. In this embodiment, three concertina coils 14, 16 and 18 are provided. It is envisioned that barrier 10 may include one or more coils, e.g., 5, 6, 7 etc. Coils 14 and 16 are positioned in axial alignment to define a base of barrier 10. Coil 18 is positioned on top of coils 14 and 16 and is secured to coils 14 and 16 at multiple locations along its length by clips 28 (FIG. 2) to provide added stability to barrier system 10. Alternately, coil 18 may be secured to coils 14 and 16 using welds, rings, ties or the like.

Figure 3:
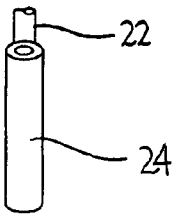
FIG. 3 is a side cutaway view of a guide sleeve of the support member shown in FIG. 2.
Figure 2:
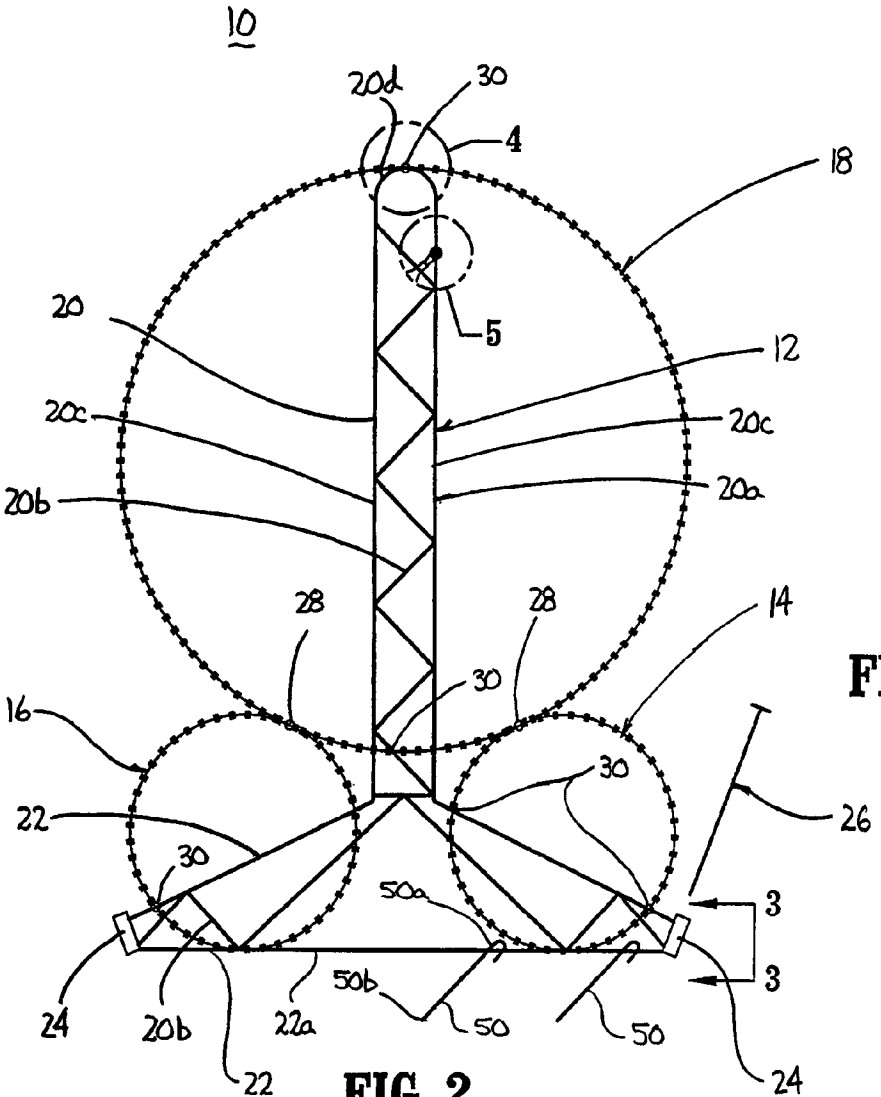
FIG. 2 is a front view of a support member of the antipersonnel barrier system shown in FIG. 1 with the concertina coils attached thereto.

Referring also to FIG. 2, each support member 12 includes a vertical section 20 and a base section 22. In one embodiment, base section 22 includes a pair of sleeves 24 (FIG. 3) dimensioned to receive anchoring structure, e.g., stakes 26 (FIG. 2) for securing support member 12 to a support surface, e.g., the ground. In one embodiment, support member 12 is formed from ¼" or ⅜" diameter hot or cold rolled steel rod, e.g., AISI 1010 steel. It is contemplated that support member 12 may be formed from rods having a variety of different diameters and/or having a variety of different configurations and that the support members 12 can be formed from a variety of different materials, e.g., plastics. Vertical section 20 and base section 22 each include an outer frame 20*a* and 22*a*, respectively, and a plurality of inner angled support members 20*b* and 22*b*, respectively. Vertical section 20 includes a pair of spaced substantially parallel legs 22*c* and a semi-circular upper portion 22*d*. Inner support members 20*b* and 22*b* provide added strength to outer frames 20*a* and 22*a*, respectively to facilitate the use of smaller diameter rods to construct support member 12. The use of smaller diameter rods is especially important since prior to deployment, antipersonnel barrier 10 is maintained as a compact unit which is transportable.

Figure 2A:
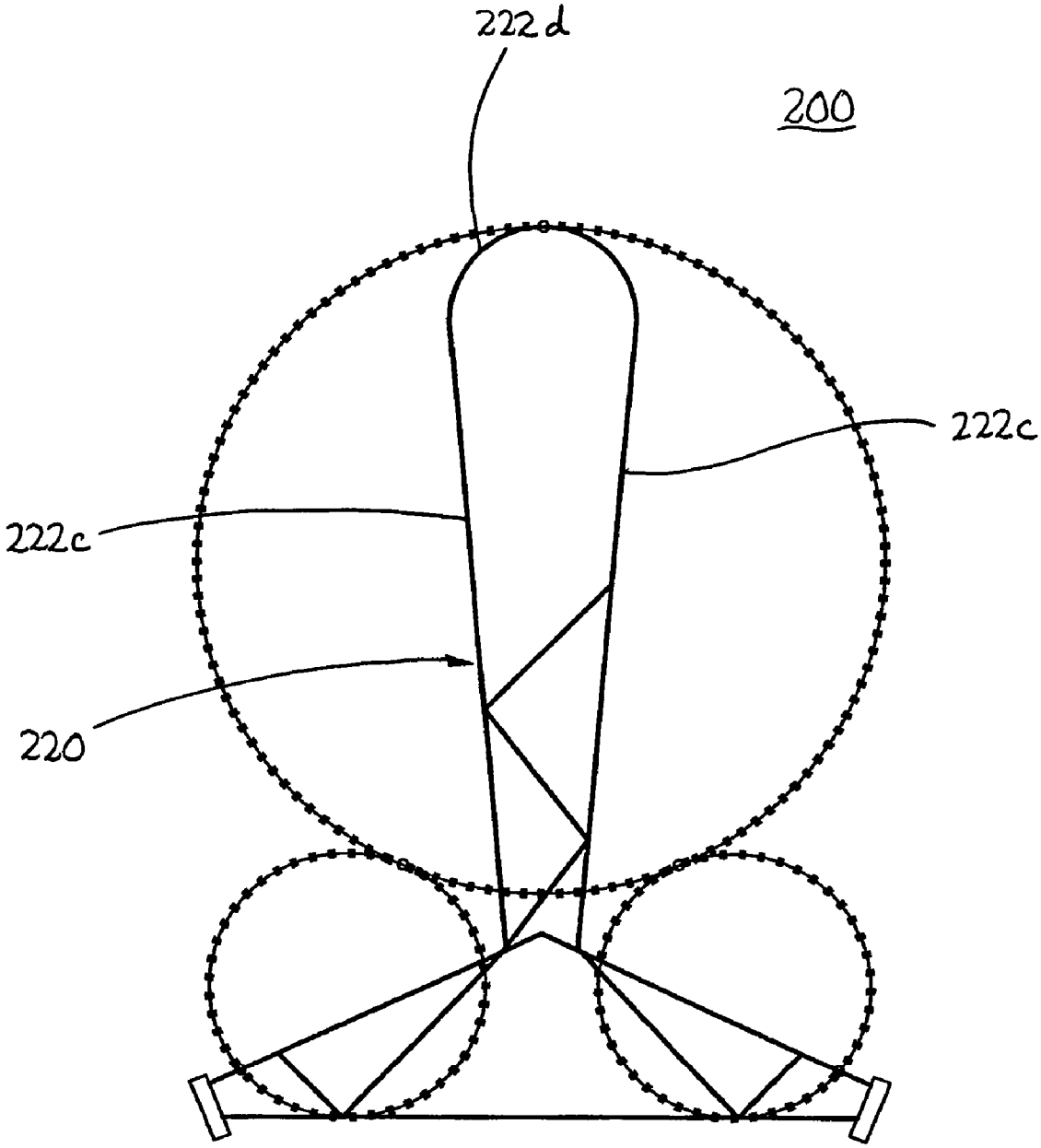
FIG. 2A is a front view of an alternate embodiment of the support member of the presently disclosed antipersonnel barrier system with the concertina coils attached thereto.

FIG. 2A illustrates an alternate embodiment of the presently disclosed antipersonnel barrier system shown generally as 200. Antipersonnel barrier system 200 is substantially identical to antipersonnel barrier system 10 except that support member 212 includes a vertical section 220 which includes diverging legs 222*c* interconnected by a semi-circular upper portion 222*d*. By providing a vertical section 220 having diverging legs 222*c*, the spacing between each of upper end of legs 222*c* is increased such that the barrier system can be more easily loaded and unloaded onto a deployment carriage 100. See FIG. 11.

Support member 12 can include a protective finish such as a polymer coating, zinc deposit, paint, etc. Selection of an appropriate finish should coincide with the selection of the particular application intended for barrier 10. Support member 12 stabilizes concertina coils 14, 16 and 18 and aids in the rapid and stable deployment of barrier 10.

Figure 4:
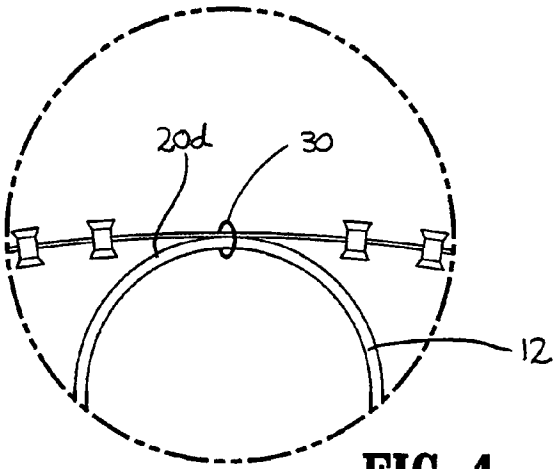
FIG. 4 is an enlarged view of the indicated area of detail shown in FIG. 2.

Referring also to FIG. 4, each of concertina coils 14, 16 and 18 is fastened to support member 12 in at least one location. In one embodiment, heavy gauge rings 30 (FIG. 4) are used to slidably attach coils 14, 16 and 18 to support member 12. Rings 30 allow for relative movement between the coils and support member 12 to facilitate coil diameter reduction during deployment of barrier 10 and for coil diameter enlargement during recovery of barrier 10. It is envisioned that other fastening techniques can be used to secure coils 14, 16 and 18 to support member 12 including both sliding and non-sliding techniques, e.g., ties, welds, etc. Preferably, vertical section 20 of support member 12 extends to at least a height substantially equal to the desired height of the top concertina coil. The top concertina coil is secured to vertical section 20 to provide vertical stability to the coil. Preferably, coils 14 and 16 are secured to base section 22 of support member 12 at two laterally spaced locations to provide horizontal stability to barrier 10.

Concertina coils 14, 16 and 18 can be formed from barbed tape as is known in the art. The barbed tape can be either wire reinforced tape or non-reinforced barbed tape. Concertina coil formed of combinations of wire reinforced and non-reinforced tape may also be used. Wire reinforced tape is available in short, medium or long barb and can be fabricated from galvanized steel, stainless steel or the like. Although only single helical concertina coils are shown, double concertina coils are also available. The barbed tape may be formed by dynamic rolling to provide for barb stiffening.

In one embodiment, each of coils 14, 16 and 18 of antipersonnel barrier 10 has an assembled length of about four hundred fifty feet, although shorter or longer assembled lengths may be desirable for particular applications. In the illustrated embodiments, concertina coils 14 and 16 which define the base of antipersonnel barrier 10 have a diameter of about twenty-four inches in their deployed configuration and concertina coil 18 which defines the top of barrier system 10 has a diameter of about fifty-eight inches in its deployed configuration. It is envisioned that the deployed diameter of any one or all of the concertina coils may be increased or decreased to meet a particular need. Further, as discussed above, the number of coils and/or the orientation of the coils may be varied to meet a particular need. For example, five coils of any diameter may be provided, where three of the coils define the base of the barrier and two of the coils define the top side of the barrier.

Figure 5:
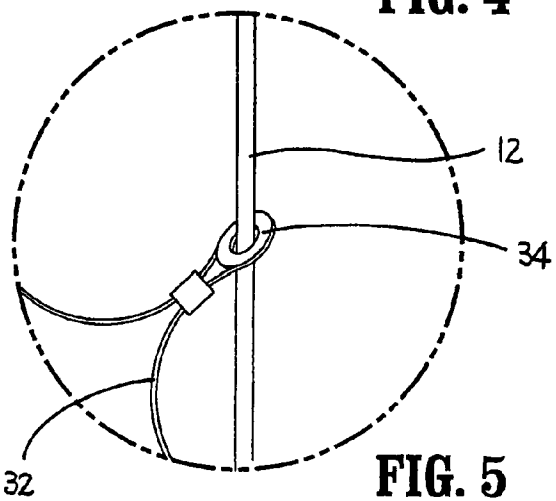
FIG. 5 is an enlarged view of the indicated area of detail shown in FIG. 2.

Referring also to FIG. 5, a length limiting cable 32 can be secured between each of support members 12. Cable 32 prevents separation of support members 12 beyond a predetermined limit, e.g, nine feet. By limiting the separation of support members 12, over extension of coils 14, 16 and 18 is prevented. In one embodiment, cable 32 is formed from ⅛ inch diameter stranded steel cable and is secured to an inner support member 20*b* of vertical section 20 of support member 12 with a clip (not shown). It is envisioned that cable 32 may be formed from other materials including wires, bands or the like. The clip should be of the type to withstand substantial forces, e.g., 200 lbs., without separating from the support member. In an alternate embodiment shown in FIG. 5, cable 32 is secured to a circular collar or washer 34, such as by swaging. Washer 34 is slidably positioned about outer frame 20*a* of vertical section 20 of support member 12.

Figure 5A:
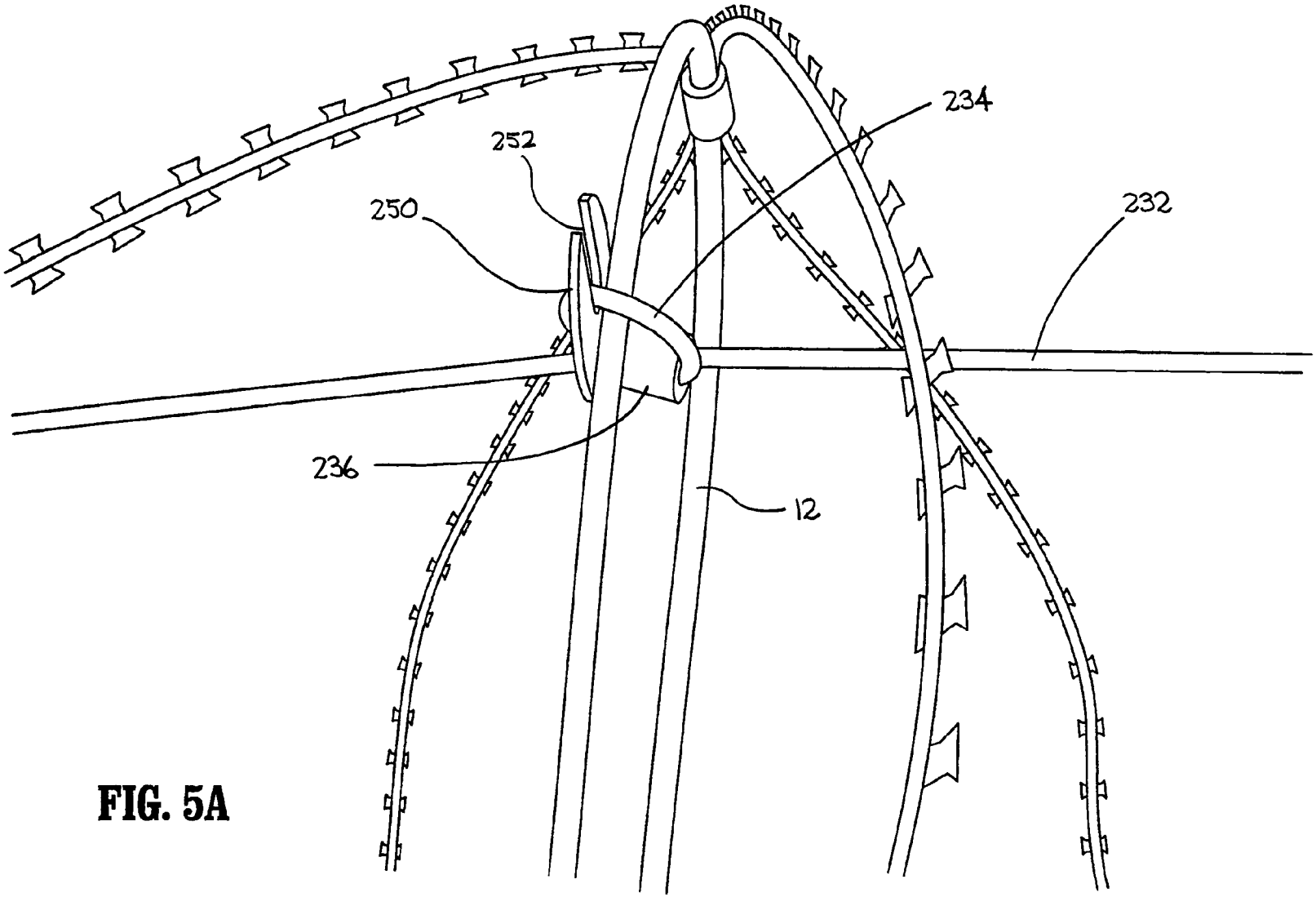
FIG. 5A is an enlarged perspective view of an alternate embodiment of structure for securing the length limiting cable to the support members.

In an alternate embodiment shown in FIG. 5A, a C-clip 250 or the like is secured to an upper portion of each support member 12 such as by welding. C-clip 250 defines a recess 252. Length limiting cable 232 is secured to each support member 12 by wrapping cable 232 in a loop 234 about C-clip 250 and support member 12 such that cable 232 is positioned within recess 252. C-clip 250 prevents cable 232 from sliding down support member 12. A material 236, e.g., aluminum, can be formed about, e.g., swaged, a portion of cable loop 234 to ensure that loop 234 does not become disengaged from C-clip 250. By providing the C-clip/swaging to connect cable 232 to support members 12, the forces required to separate cable 232 from support members 12 are greatly increased.

Figure 8:
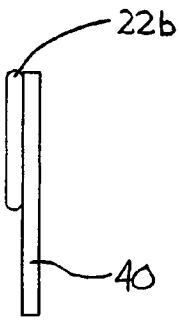
FIG. 8 is a side view of a base section of the support member shown in FIG. 6.

As discussed above, stakes 26 (FIG. 2) may be driven through sleeves 24 of support member 12 to secure base section 22 to a support surface, e.g., the ground. In one embodiment, stakes 26 are between about 18 inches and 24 inches in length. Alternately, stakes of other lengths may be desirable. Sleeves 24 can be positioned at angle to a vertical axis or parallel thereto. In an alternate embodiment shown in FIGS. 6 and 8, base section 22 can include anchoring structure formed integrally therewith. In one embodiment, the anchoring structure includes stakes 40 which extend downwardly from outer frame 22*b* of base section 22 of support member 12. In one embodiment, stakes 40 are about three inches in length. Alternately, other lengths may be desirable to provide more secure anchoring of barrier system 10.

It is envisioned that other anchoring structures may be provided to secure antipersonnel barrier system 10 at a fixed deployed position. For example, as illustrated in FIG. 2, a hooking device 50 having a hook portion 50*a* and a ground penetrating portion 50*b* may be provided to anchor support members 12. Hook portion 50*a* is configured to engage base section 22 of support member 12 to anchor support member 12.

Figure 7:
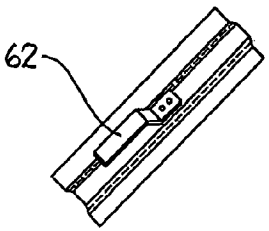
FIG. 7 is an enlarged view of a fastening member of the anchoring structure of the antipersonnel barrier system shown in FIG. 6.
Figure 6:
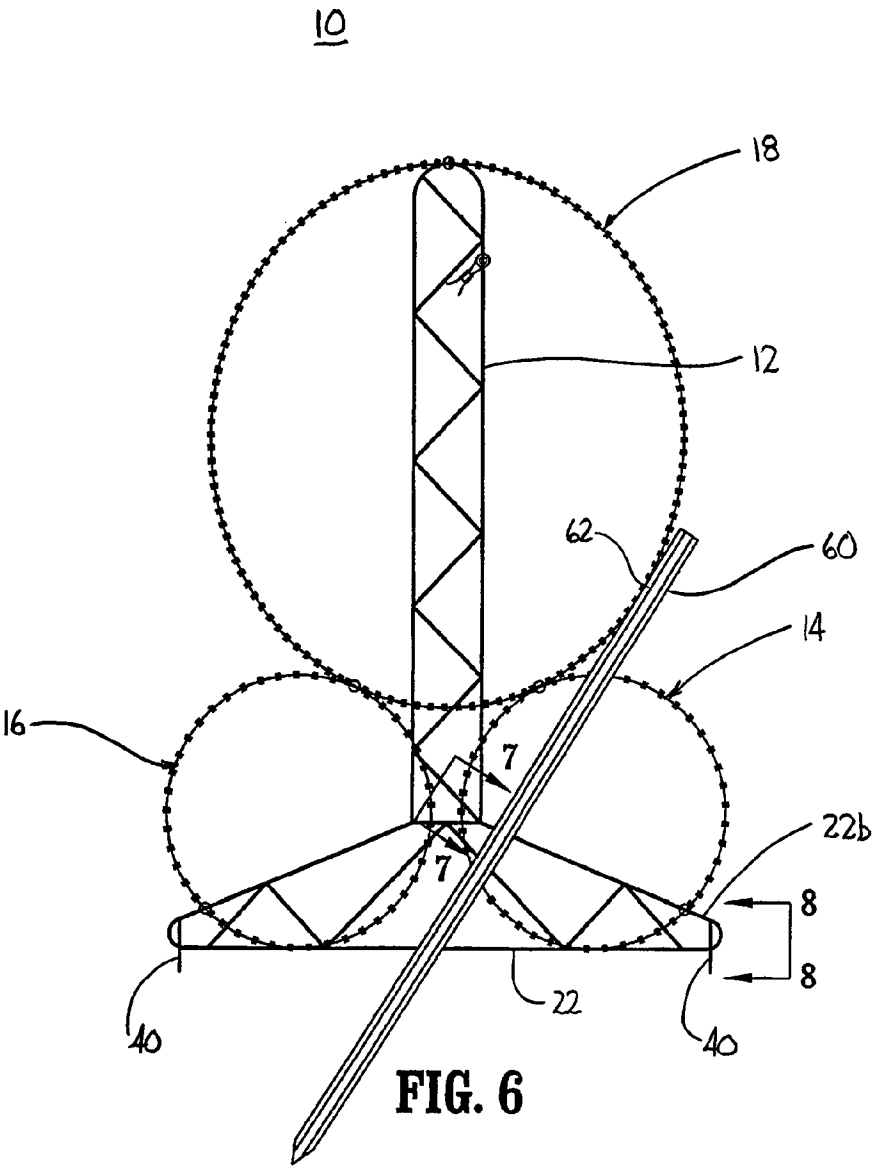
FIG. 6 is a front view of another embodiment of a support member of the presently disclosed antipersonnel system barrier shown in FIG. 1.

In another embodiment shown in FIGS. 6 and 7, a large stake 60 having clips 62 (FIG. 7) includes a pointed end. Stake 60 can be driven into the ground adjacent coils 14, 16 and 18 and/or support member 12 such that clips 62 receive or engage a portion of one or more of the coils and/or the support member to anchor the barrier system 10 in place. It is noted that any or all of the anchoring structures disclosed herein may be used in combination with any or all of the other anchoring structures. Moreover, the stakes may be constructed from rebar, steel rods or any material meeting the requisite strength requirements.

Figure 11:
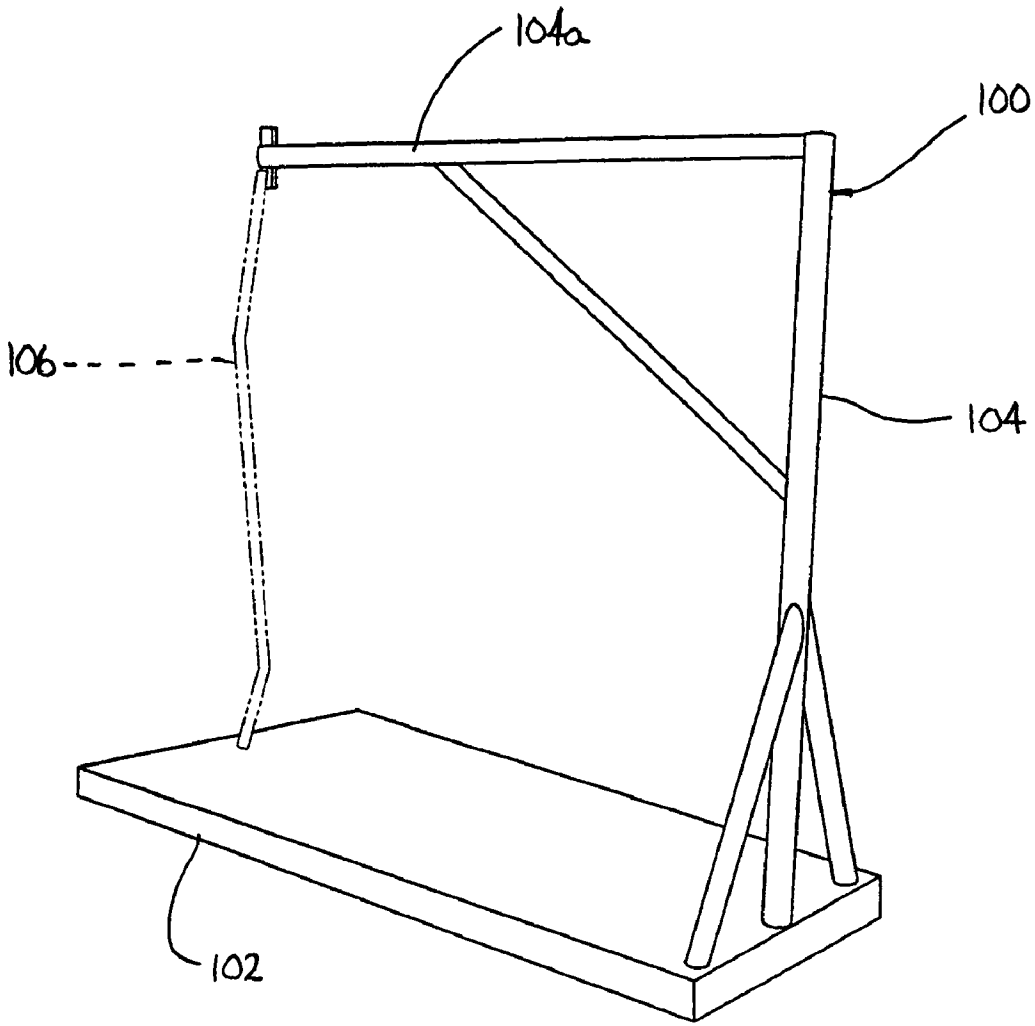
FIG. 11 is a side perspective view of a storage and deployment carriage for the presently disclosed antipersonnel barrier system.

Referring to FIG. 11, a deployment carriage 100 includes a base portion 102 and a hangar portion 104. Hangar portion 104 includes a cantilevered arm 104*a* for supporting antipersonnel barrier system 10 in its undeployed state. A retainer bar 106 is removably supported between a distal end of arm 104*a* and base portion 102 to secure antipersonnel barrier system 10 on hangar portion 104. Deployment carriage 100 is preferably dimensioned to be supported on the bed of a motor vehicle, e.g., truck, although other deployment devices may also be used.

Figure 9:
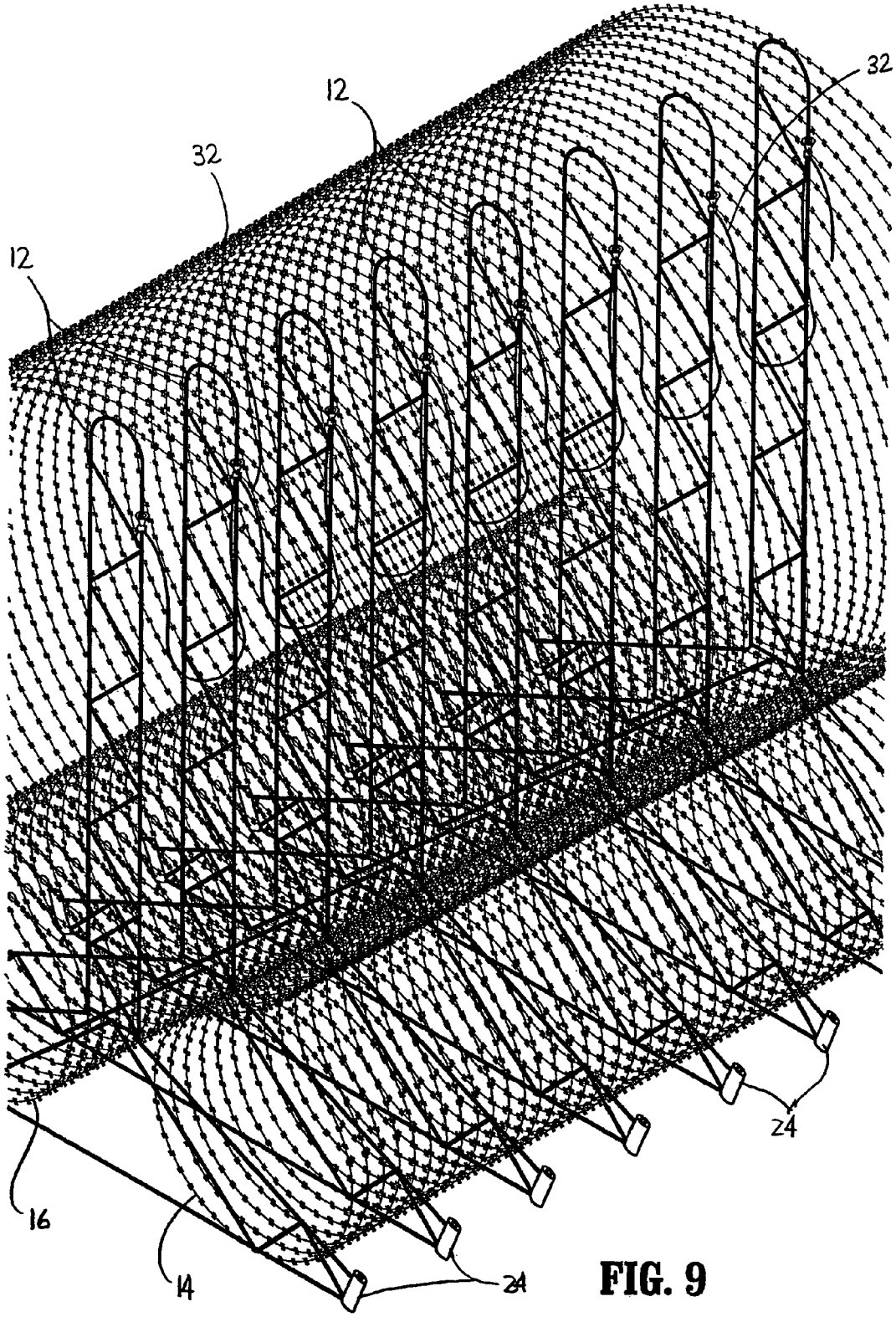
FIG. 9 is a side perspective view of a portion of the antipersonnel barrier system shown in FIG. 1 prior to deployment.
Figure 10:
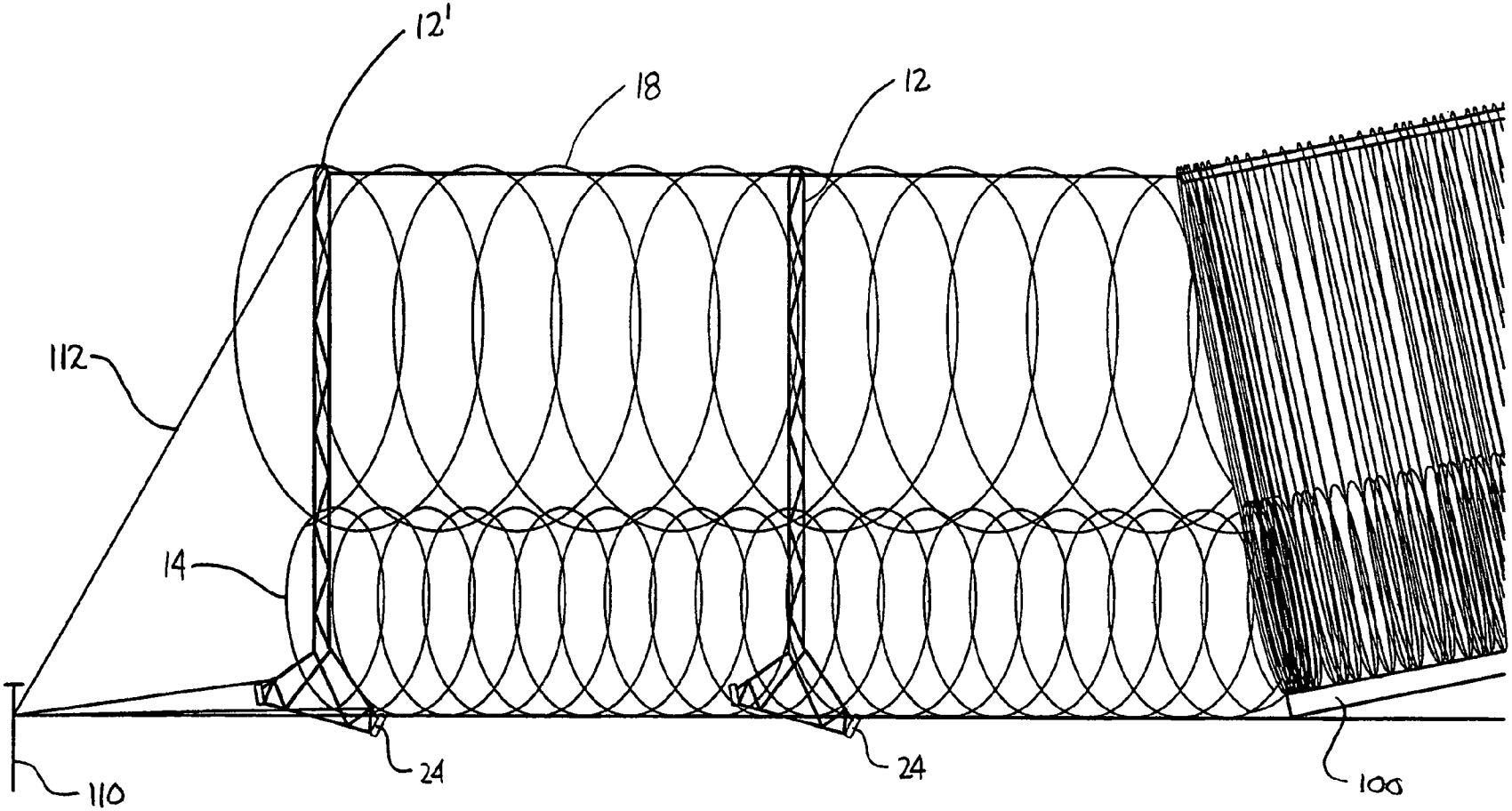
FIG. 10 is a side perspective view of a leading end of the antipersonnel barrier system shown in FIG. 1 in a partially deployed state.

Referring to FIG. 9, in its undeployed state, coils 14, 16 and 18 of antipersonnel barrier system 10 are compressed and support members 12 are positioned in close alignment. (It is noted that in its actual non-deployed state, barrier system 10 is substantially more compact than as illustrated). As such, cable 32 is slackened. During installation or deployment, the leading end support member 12' (FIG. 10) is secured or anchored to a support surface using a stake 110 or the like and a mounting cable 112. Thereafter, deployment carriage 100 is moved in the direction of deployment to allow for axial extension of the coils and spacing of support members 12. A person or persons deploying the device should ensure maximum extension of cable 32 to provide proper spacing between support members 12. It is recommended that three people deploy the barrier system including one driver and two assistants. The two assistants should ensure proper placement of the support members and see that no tangles occur in the concertina coils during deployment.

It will be understood that various modifications may be made to the embodiments disclosed herein. For example, the particular configuration of the support members may be modified so long as the support members provide vertical and horizontal stability to the barrier system. Therefore, the above description should not be construed as limiting, but merely as exemplifications of preferred embodiments. Those skilled in the art will envision other modifications within the scope and spirit of the claims appended hereto.

What is claimed is:

1. A barrier assembly comprising:

at least one concertina coil which is axially extendable from a compressed state to a elongated deployed state;

a plurality of support members secured to the at least one concertina coil, the plurality of support members comprising a vertical section and a base section, with the vertical section having at least a first leg, a second leg and inner support members therebetween;

a length limiting cable extending between the support members, the cable engaged with the vertical section of each support member to prevent separation of the adjacent support members beyond a predetermined distance and wherein the engagement of the cable to the vertical section allows free movement of the cable along the vertical section of each of the support members in a direction transverse to a longitudinal axis of the cable; and stake anchoring structures for securing the support members of the barrier system to a support surface, wherein the stake anchoring structures engage the base section of the support members.

2. A barrier system according to claim 1, wherein the at least one concertina coil includes a plurality of concertina coils.

3. A barrier system according to claim 1, wherein the cable is secured to the support members by a circular collar.

4. A barrier system according to claim 1, wherein the cable is looped about the support members.

5. A barrier system according to claim 1, wherein the support members include at least one sleeve for slidably receiving the anchoring structure.

6. A barrier system according to claim 5, wherein the at least one sleeve includes a sleeve secured to each side of the base section of the support member.

7. A barrier system according to claim 1, wherein the anchoring structure includes a hooking device having one end configured to engage a base section of the support member and a second end configured to penetrate the support surface.

8. The barrier system of claim 1, wherein the length limiting cable is engaged with one of the first and second legs of the vertical section.

9. The barrier system of claim 1, wherein the vertical section of each of said plurality of support members has a lower end adjacent said base section and an upper end opposite said base section, and wherein the first and second legs of each of the plurality of support members diverge such that a spacing between the first and second legs at said upper end is greater than a spacing between the first and second legs at said lower end.

10. The barrier system of claim 1, wherein the at least one concertina coil includes a plurality of concertina coils, the barrier system comprising a stake having a plurality of clips for engaging each of the plurality of concertina coils, the stake comprising a support structure engaging end, wherein the system anchors each of the plurality of concertina coils to the support structure.

11. A method for securing a barrier system comprising the steps of:

(a) extending the barrier system of claim 1, and (b) securing the extended barrier system to a support surface with the anchoring structures of the barrier system.

12. A method according to claim 1l wherein the anchoring steps secures the support members of the barrier system to the support surface.

13. A method according to claim 11 wherein the securing step includes passing at least one stake through a sleeve secured to a support member and penetrating the support surface.

14. A method according to claim 11 wherein the securing step includes a hooking device having one end configures to engage a support member and a second end configured to penetrate the support surface.

15. A method according to claim 11 wherein the securing of the barrier system further comprises securing a leading end support member to a support surface, prior to extending the barrier system.

16. A barrier system, comprising a concertina coil which is axially extendable from a compressed state to an elongated deployed state;

a plurality of support members secured to the concertina coil, the plurality of support members comprising a vertical section and a base section;

a length limiting cable extending between the support members, the cable engaged with each support member to prevent separation of the adjacent support members beyond a predetermined distance, the length limiting cable engaged with each support member by a C-clip mounted thereto comprising a flat plate with a recess, the cable positioned within the recess and wrapped in a loop about the flat plate to prevent the cable from moving with respect to the support member; and an anchoring structure for securing the support members of the barrier system to a support surface, wherein the anchoring structure engages the base section of the support members.

17. The barrier system of claim 16, wherein a swaged portion is positioned on the cable immediately adjacent the C-clip to prevent the loop from disengaging from the C-clip.

18. The barrier system of claim 16, wherein the vertical section of each of said plurality of support members includes first and second spaced apart legs, the vertical section of each of said plurality of support members having a lower end adjacent said base section and an upper end opposite said base section, and wherein the first and second spaced apart legs of each of the plurality of support members diverge such that a spacing between the first and second legs at said upper end is greater than a spacing between the first and second legs at said lower end.

19. The barrier system of claim 16, wherein the concertina coil comprises a plurality of concertina coils, the barrier system comprising a stake having a plurality of clips for engaging each of the plurality of concertina coils, the stake comprising a support structure engaging end, wherein the system anchors each of the plurality of concertina coils to the support structure.

* * * * *